United States Patent [19]

Blease

[11] Patent Number: 4,496,068

[45] Date of Patent: Jan. 29, 1985

[54] CONTAINER ASSEMBLY

[75] Inventor: Wilfred J. Blease, Greenville, N.H.

[73] Assignee: Pioneer Plastics, Inc., Greenville, N.H.

[21] Appl. No.: 579,729

[22] Filed: Feb. 13, 1984

Related U.S. Application Data

[63] Continuation of Ser. No. 164,580, Jun. 30, 1980, abandoned.

[51] Int. Cl.[3] ..... B65D 21/02; A47G 23/64

[52] U.S. Cl. ..... 220/4 D; 206/501; 220/294; 222/143

[58] Field of Search ..... 206/501; 220/4 D, 294; 222/143

[56] References Cited

U.S. PATENT DOCUMENTS

| | | | |
|---|---|---|---|
| 231,156 | 8/1880 | Doherty | 220/4 D |
| 3,369,691 | 2/1968 | Wei | 220/4 D |
| 4,078,701 | 3/1978 | Clubb | 206/501 |

FOREIGN PATENT DOCUMENTS

| | | | |
|---|---|---|---|
| 456193 | 11/1936 | United Kingdom | 222/143 |
| 1457463 | 12/1976 | United Kingdom | 220/294 |

*Primary Examiner*—George E. Lowrance

[57] ABSTRACT

A described container assembly has an open top lower container and a cover adapted to be releasably assembled and locked on top of the container by their relative rotation. The container has outwardly extending opposed locking grooves within its inner side walls, and the cover has opposed outwardly extending locking flanges for cooperating with the container opposed grooves for assembly upon relative rotation from an initial position to a locked position.

4 Claims, 7 Drawing Figures

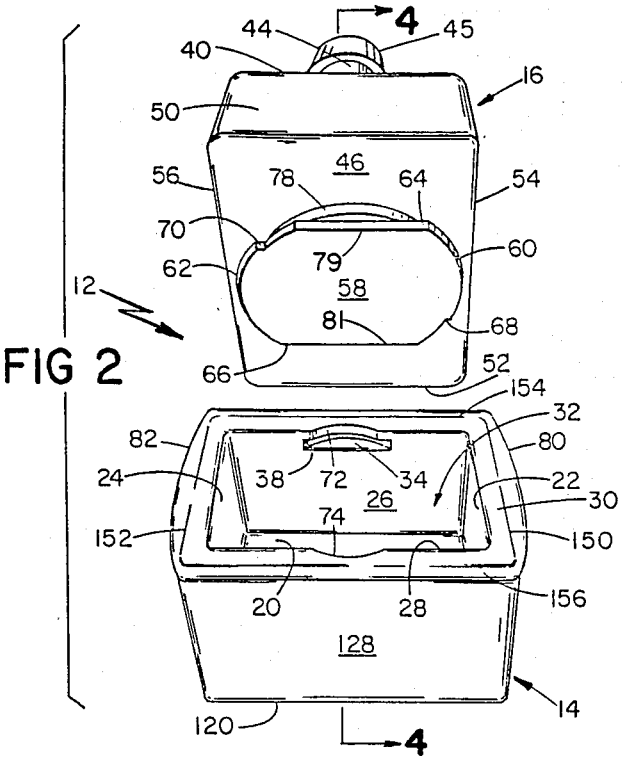
FIG 2
FIG 1
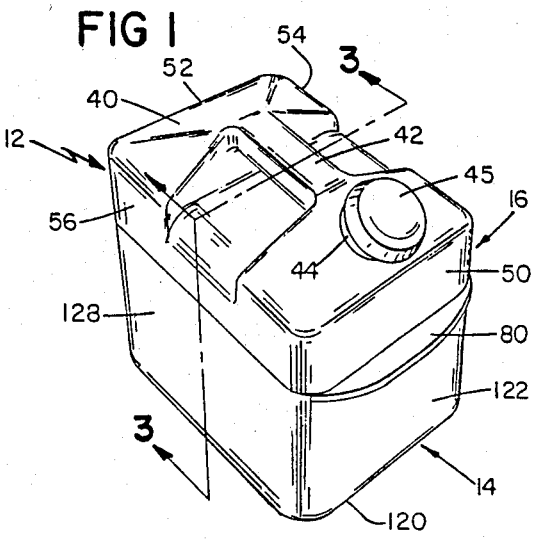
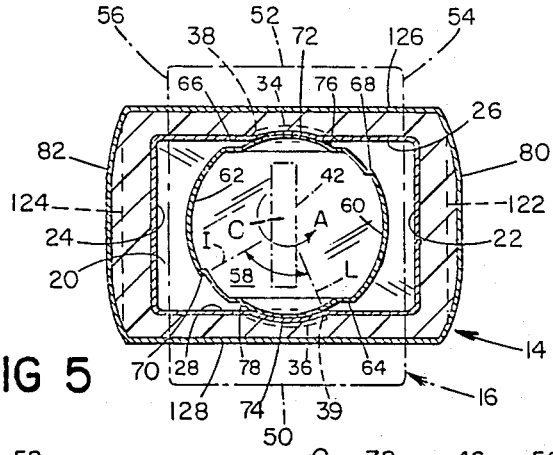
FIG 5
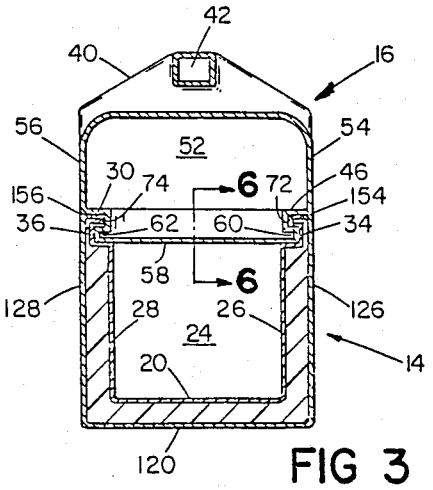
FIG 3
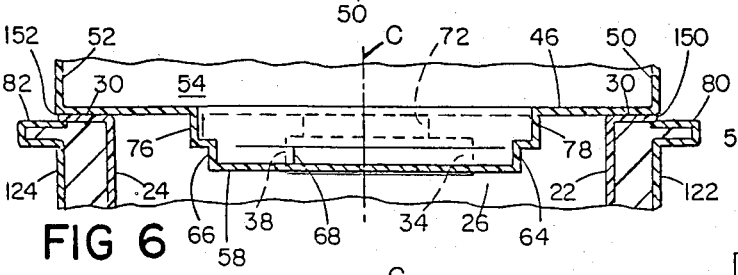
FIG 6
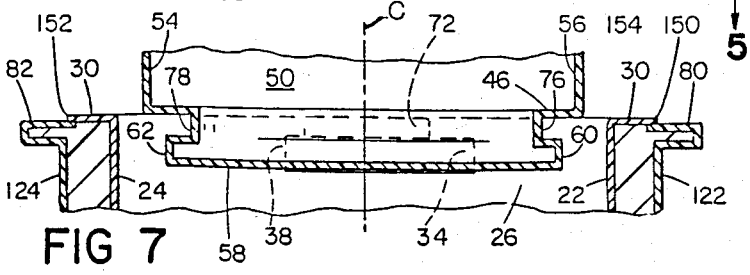
FIG 7
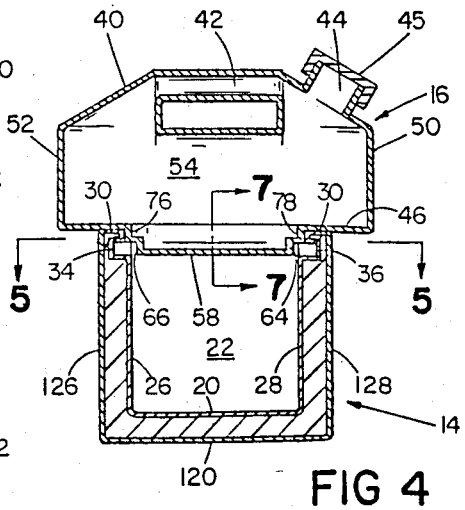
FIG 4

CONTAINER ASSEMBLY

RELATED APPLICATIONS

This application is a continuation of U.S. patent application Ser. No. 164,580, filed June 30, 1980, now abandoned. Its invention relates to container assemblies.

BACKGROUND OF THE INVENTION

Container assemblies which have lockable covers are well known in the prior art. However, such container assemblies are usually deficient in several aspects. The patents to Hoffstadt, U.S. Pat. No. 3,384,259, and Clubb, U.S. Pat. No. 4,078,701, for example, are evidence of such deficiencies, such as being composed of many parts, and having multiple external latching means, for example.

Accordingly, it is a major object of the present invention to provide a novel container assembly which has a single internal locking means for locking its cover and container by their relative rotation.

SUMMARY OF THE INVENTION

In order to accomplish the above and still further objects, the present invention provides a container assembly including a generally rectangular open top container and a cover adapted to be releasably assembled and locked on top of it by their relative rotation.

The container has generally rectangular inner and outer spaced parallel bottom walls, generally rectangular inner and outer spaced parallel end and side walls, and a generally rectangular planar peripheral top wall extending between the inner and outer end and side walls and defining a generally rectangular central top opening which may be said to have a central axis of rotation perpendicular to the plane of the container peripheral top wall.

According to the invention, the container inner side walls may have integral aligning and locking means, including opposed arcuate recessed aligning surfaces of predetermined radius from the central axis of rotation extending outwardly into the container inner side walls and downwardly from the container top wall, and outwardly extending opposed arcuate locking grooves coaxial with and of greater radius from said central axis of rotation than that of said recessed aligning surfaces extending outwardly into said container inner side walls and located at the lower end of said recessed aligning surfaces spaced downwardly from and parallel to the plane of said lower container peripheral top wall.

The cover has a top wall and a bottom wall with a generally rectangular generally planar peripheral outer wall portion, and, according to the invention, may have integral aligning and locking means extending downwardly from its bottom wall generally centrally thereof, including generally arcuate aligning surface portions extending downwardly from the cover bottom wall, the arcuate surface portions having a radius from the central axis of rotation for cooperating with the lower container recessed aligning surfaces to align the cover and lower container in their initial assembled position with the cover bottom wall and said lower container top wall in planar contact at a horizontal angle to one another.

Opposed aligning walls may be provided spaced downwardly from the arcuate aligning surface portions parallel to the end walls of the cover and spaced apart a distance less than the distance between the container inner side walls and at a distance from the central axis of rotation less than the radius of the arcuate aligning surface portions.

Opposed outwardly extending arcuate locking flanges are provided in a plane parallel to and spaced downwardly from the peripheral outer portion of the cover bottom wall, extending between the aligning walls, the locking flanges in the initial assembled position of the container and cover having a radius from the axis of rotation greater than that of the arcuate aligning surface portions and cooperating with the container opposed locking grooves for locking assembly of the cover and container upon unidirectional relative rotation of the cover and the container in the plane of the container peripheral top wall and the cover bottom wall from its initial assembled position to its locked position.

The container assembly of the invention has, in its assembled and locked position, the peripheral outer portion of the cover bottom wall in contact with the container peripheral top wall with the outer end and side edges of the cover bottom wall generally contiguous with the outer end and side edges of the container peripheral top wall.

The cover opposed flanges may be generally arcuate of increasing radius in the assembly direction of relative rotation and the opposed locking flanges and the container may include cooperating stop means both for preventing relative rearward rotation of the container assembly in the direction opposite to its assembly direction during assembly and for preventing continued rotation of the assembly assembly beyond its locked position.

DESCRIPTION OF THE PREFERRED EMBODIMENT

Other objects, features, and advantages of the invention will appear from the following detailed description of a preferred embodiment thereof, taken together with the accompanying drawings, wherein:

FIG. 1 is a perspective view of a dual container assembly of the invention in its assembled and locked position;

FIG. 2 is an exploded perspective view of the dual container assembly shown in FIG. 1, with the cover container bottom wall and the lower container side wall and the aligning and locking means for both in view;

FIG. 3 is a vertical cross-sectional end view taken along line 3—3 of FIG. 1, with the containers in assembled and locked position;

FIG. 4 is a vertical cross-sectional end view taken along line 4—4 of FIG. 2, with the containers in initial assembled and released position;

FIG. 5 is a cross-sectional top view taken along line 5—5 of FIG. 4;

FIG. 6 is a vertical cross-sectional detail view taken along line 6—6 of FIG. 3; and FIG. 7 is a vertical cross-sectional detail view taken along line 7—7 of FIG. 4.

Referring to the drawings, a novel dual container assembly, generally designated 12, is provided for transporting different materials in separate containers. The dual container assembly 12 comprises a thermally insulated open top lower container, generally designated 14, and an enclosed integrally blow-molded hollow upper cover container of generally uniform wall thickness, generally designated 16, which is adapted to be releasably assembled and locked on top of lower container 14 by their relative rotation.

More particularly, lower container 14 includes, as best shown in FIGS. 2, 3, 4 and 5, a generally rectangular inner bottom wall 20 and outer bottom wall 120, which are spaced parallel from each other; generally rectangular inner end walls 22, 24 and outer end walls 122, 124, which are also spaced parallel from each other, generally rectangular inner side walls 26, 28 and outer side walls 126, 128, which are also spaced parallel from each other; and a generally rectangular planar peripheral top wall 30. Thermal insulation is provided between the spaced walls. Peripheral top wall 30, which extends between the inner and outer end and side walls 22, 24, 26, 28, 122, 124, 126 and 128, defines a generally rectangular central top opening 32, having a central axis of rotation C, as shown in FIGS. 5, 6 and 7, perpendicular to the plane of the peripheral top wall 30 of lower container 14.

According to the invention, the lower container inner side walls 26 and 28 have integral aligning and locking means which include opposed arcuate recessed aligning surfaces 72 and 74 and opposed arcuate recessed locking grooves 34 and 36 coaxial therewith. Aligning surfaces 72 and 74 are of predetermined radius from central axis of rotation C and extend outwardly into the lower container inner side walls 26 and 28 and downwardly from the peripheral top wall of lower container 14. Opposed arcuate locking grooves 34 and 36 extend outwardly into the lower container inner side walls 26 and 28, are located at the lower end of recessed aligning surfaces 72 and 74, are spaced downwardly from and parallel to the plane of the peripheral top wall of lower container 14, and are coaxial with and of greater radius from central axis of rotation C than that of recessed aligning surfaces 72 and 74. Grooves 34 and 36 each has an assembly direction rotation stop 38 and 39 at one end thereof.

Lower container 14 further includes integral outwardly extending lifting flanges 80 and 82 on its outer end walls 122 and 124 parallel to and adjacent to lower container peripheral top wall 30 for lifting lower container 14.

Cover container 16, as best shown in FIGS. 2, 3, 4 and 5, being blow molded, is hollow and has a top portion 40 that includes an integral recessed hollow handle 42 and a filling opening 44 having a suitable closure 45, and a generally rectangular bottom wall 46.

According to the invention, cover container bottom wall 46 has integral aligning and locking means, generally designated 58, extending downwardly therefrom generally centrally thereof, including generally arcuate aligning surface portions 76 and 78, opposed aligning walls 79 and 81 and outwardly extending arcuate locking flanges 60 and 62, both of the latter being spaced downwardly from cover container bottom wall 46 and aligning surface portions 76 and 78.

Generally arcuate aligning surface portions 76 and 78 extend downwardly from cover container bottom wall 46, said surface portions having a radius from central axis of rotation C for cooperating with the lower container recessed aligning surfaces 34 and 36 to align cover container 16 and lower container 14 into their initial assembled release position with cover container bottom wall 46 and lower container top wall 30 in planar contact at a horizontal 90 degree angle to one another, as shown in FIGS. 4 and 7.

Opposed aligning walls 79 and 81 are spaced downwardly from arcuate aligning surface portions 76 and 78; are parallel to end walls 50 and 52 of cover 16; are spaced apart a distance less than the distance between lower container inner side walls 26 and 28; and are at a distance from the central axis of rotation C less than the radius of arcuate aligning surface portions 76 and 78.

Opposed arcuate locking flanges 60 and 62 are located in a plane parallel to and spaced downwardly from the peripheral outer portion of the cover container bottom wall 46 and extend between aligning walls 79 and 81, said locking flanges having a radius from axis of rotation C greater than that of arcuate aligning surface portions 76 and 78. Locking flanges 60 and 62 cooperate with lower container opposed locking grooves 34 and 36 for locking assembly of cover container 16 and lower container 14 upon their 90 degree unidirectional relative rotation A, in the plane of lower container peripheral top wall 30 and cover container bottom wall 46, from their initial assembled and released position I, as shown in FIGS. 4, 5 and 7, to their locked position, as shown in FIGS. 1, 3 and 6.

Cover container opposed locking flanges 60 and 62 are preferably of increasing radius in the assembly direction of relative rotation A of containers 16 and 14, as shown in FIGS. 2 and 5, and each includes a rearward direction stop 64 and 66 at its end of greater radius and a forward direction assembly stop 68 and 70 at its end of least radius for preventing relative rotation A in the direction opposite to the assembly direction during assembly of containers 16 and 14 and for stopping relative rotation A beyond 90 degrees, respectively.

In operation, dual container assembly 12 is capable of transporting different materials in separate containers. For example, cover container 16 is capable of receiving liquids or ice cubes through filling opening 44. Lower container 14 is capable of receiving either solid or liquid materials.

To assemble the dual container assembly 12, as best shown in FIGS. 3 through 7, cover container 16 is first placed into its initial assembled released position I at a 90 degree horizontal angle across the generally rectangular central top opening 32, with cover container bottom wall 46 perpendicular to axis of rotation C and to lower container inner and outer side walls 26, 28, 126 and 128. Opposed aligning walls 79 and 81 and arcuate aligning portions 76 and 78, both of cover container locking means 58, in cooperation with lower container inner side walls 26 and 28 and their aligning recesses 72 and 74, guide containers 16 and 14 into initial assembled released position I, for relative rotation about central axis of rotation C with cover container opposed locking flanges 60 and 62 and lower container opposed locking grooves 34 and 36 in the same plane.

Next, to lock the container assembly 12, as best shown in FIGS. 5, 6 and 7, cover container 16 is unidirectionally rotated 90 degrees in assembly direction A from its initial position I to its locked position L. Rearward direction stops 64 and 66 of flanges 60 and 62 contact lower container inner side walls 26, 28 to prevent rotation of cover container 16 in the direction opposite to assembly direction A. Similarly, forward direction stops 68 and 70 of flanges 60 and 62, in cooperation with stops 39 and 40 of grooves 34 and 36, prevent rotation of cover container 16 beyond its locked position L.

Cover container 16, in its assembled and locked position, has the peripheral outer portion of its bottom wall 46 in sealing contact with the lower container peripheral top wall 30, with the outer end edges 50, 52 and side edges 54, 56 of cover container bottom wall 46 generally contiguous with the outer end edges 150, 152 and side edges 154, 156 of the lower container peripheral top wall 30.

To release the assembled and locked container assembly 12, cover container 16 is simply rotated 90 degrees in the reverse direction to its initial released position I, after which it can be lifted vertically from lower container 14.

Various modifications of the herein described invention, including its use as a single container with a cover, within the spirit thereof and the scope of the appended claims, will be apparent to those skilled in the art.

What is claimed is:

1. A container assembly including a generally rectangular open top container and a cover adapted to be releaseably assembled and locked on top of said container by their relative rotation, said container having generally rectangular inner and outer spaced parallel bottom walls, generally rectangular inner and outer spaced parallel end and side walls, and a generally rectangular planar peripheral top wall extending between said inner and outer end and side walls and defining a generally rectangular central top opening having a central axis of rotation perpendicular to the plane of said container peripheral top wall said container inner side walls having integral aligning and locking means including opposed arcuate recessed aligning surfaces of predetermined radius from said central axis of rotation extending outwardly into both said container inner side walls and said container top wall and extending downwardly from said container top wall, and outwardly extending opposed arcuate locking grooves concentric with and of greater radius from said central axis of rotation than that of said recessed surfaces, said arcuate locking grooves extending outwardly into said container inner side walls, located below and parallel with said recessed aligning surfaces, and spaced downwardly from and parallel to the plane of said container peripheral top wall, and said cover having a top wall and a bottom wall with a generally rectangular generally planar peripheral outer wall portion said cover bottom wall having integral aligning and locking means extending downwardly therefrom generally centrally thereof including generally arcuate aligning surface portions extending downwardly from said cover bottom wall, said aligning surface portions having a radius from said central axis of rotation slightly less than the radius of said recessed aligning surfaces for cooperating with said container recessed aligning surfaces to align said cover and container in their initial assembled position with said cover bottom wall and said container top wall in planar contact at a horizontal angle to one another opposed outwardly extending arcuate locking flanges in a plane parallel to and spaced downwardly from said aligning surface portions, said locking flanges in the initial assembled position of said container and cover having a radius from said axis of rotation greater than that of said arcuate aligning surface portions and slightly less than that of said arcuate locking grooves and cooperating with said container opposed locking grooves for locking assembly of said cover and container upon unidirectional relative rotation of said cover and said container in the plane of said container peripheral top wall and said cover bottom wall from its initial assembled position to its locked position, and said container assembly having, in its assembled and locked position, the peripheral outer portion of said cover bottom wall in contact with said container peripheral top wall with the outer end and sides edges of said cover bottom wall generally contiguous with the outer end and side edges of said container peripheral top wall.

2. A container assembly including a generally rectangular open top container and a cover adapted to be releaseably assembled and locked on top of said container by their relative rotation, said container having generally rectangular inner and outer spaced parallel bottom walls, generally rectangular inner and outer spaced parallel end and side walls, and a generally rectangular planar peripheral top wall extending between said inner and outer end and side walls and defining a generally rectangular central top opening having a central axis of rotation perpendicular to the plane of said container peripheral top wall said container inner side walls having integral aligning and locking means including opposed arcuate recessed aligning surfaces of predetermined radius from said central axis of rotation extending outwardly into both said container inner side walls and said container top wall and extending downwardly from said container top wall, and outwardly extending opposed arcuate locking grooves concentric with and of greater radius from said central axis of rotation than that of said recessed aligning surfaces, said arcuate locking grooves extending outwardly into said container inner side walls, located below and parallel with said recessed aligning surfaces, and spaced downwardly from and parallel to the plane of said container peripheral top wall, and said cover having top wall and a bottom wall with a generally rectangular generally planar peripheral outer wall portion said cover bottom wall having integral aligning and locking means extending downwardly therefrom generally centrally thereof including generally arcuate aligning surface portions extending downwardly from said cover bottom wall, said arcuate surface portions having a radius from said central axis of rotation approximately the same as the radius of said recessed aligning surfaces for cooperating with said container recessed aligning surfaces to align said cover and container in their initial assembled portion with said cover bottom wall and said container top wall in planar contact at a horizontal angle to one another opposed additional aligning means comprising aligning walls spaced downwardly from said arcuate aligning surface portions, said aligning walls being parallel to one another and spaced apart a distance less than the distance between said container inner side walls and at a distance from said central axis of rotation less than the radius of said arcuate aligning surface portions, said aligning walls cooperating with said container inner side walls to align said cover and container in their initial assembled position with said cover bottom wall and said container top wall in planar contact at a horizontal angle to one another opposed outwardly extending arcuate locking flanges in a plane parallel to and spaced downwardly from said aligning surface portions and extending between said aligning walls, said locking flanges in the initial assembled position of said container and cover having a radius from said axis or rotation greater than that of said arcuate aligning surface portions and cooperating with said container opposed locking grooves for locking assembly of said cover and container upon unidirectional relative rotation of said cover and said container in the plane of said container peripheral top wall and said cover bottom wall from its initial assembled position to its locked position, and said container assembly having, in its assembled and locked position, the peripheral outer portion of said cover bottom wall in contact with said container peripheral top wall with the outer end and side edges of said cover bottom wall generally contiguous with the outer end and side edges of said container peripheral top wall.

3. A container assembly as claimed in claims 1 or 2 wherein said opposed locking flanges and said container include cooperating stop means both for preventing relative rearward rotation of said container assembly in the direction opposite to its assembly direction during assembly of said cover and said container and for preventing continued rotation of said container assembly beyond its locked position.

4. A container assembly as claimed in claim 3, wherein said cover opposed flanges are generally arcuate of increasing radius in the assembly direction of relative rotation of said upper cover and said container.

* * * * *